United States Patent [19]

Riuli et al.

[11] 4,096,962

[45] Jun. 27, 1978

[54] RING OPENER FOR HERMETICALLY SEALED MOLDED PLASTIC CONTAINERS

[75] Inventors: Arduino E. Riuli, Wayne; Bernard F. Kopacz, Little Falls, both of N.J.

[73] Assignee: Becton, Dickinson and Company, Rutherford, N.J.

[21] Appl. No.: 820,584

[22] Filed: Aug. 1, 1977

[51] Int. Cl.[2] ..... B65D 1/02

[52] U.S. Cl. ..... 215/32; 215/250; 401/132

[58] Field of Search ..... 215/32, 250, 252, 253; 401/132

[56] References Cited

U.S. PATENT DOCUMENTS

| | | | |
|---|---|---|---|
| 1,018,107 | 2/1912 | Friedman | 215/250 |
| 3,750,820 | 8/1973 | Laharre | 215/253 |
| 3,804,282 | 4/1974 | Komendowski | 215/32 |

*Primary Examiner*—Herbert F. Ross
*Attorney, Agent, or Firm*—Kane, Dalsimer, Kane, Sullivan and Kurucz

[57] ABSTRACT

The disclosure is of a ring type opener for removing the cap portion of a hermetically sealed molded plastic container having an integrally molded cap portion. The opener includes a means for engaging and holding the cap during and after removal, in a plane parallel to the normal axis of the container so that it will lift evenly and remain within the ring opener following severance.

3 Claims, 5 Drawing Figures

RING OPENER FOR HERMETICALLY SEALED MOLDED PLASTIC CONTAINERS

BACKGROUND OF THE INVENTION

1. Field of the Invention

The invention relates to devices for opening integrally capped, hermetically sealed, plastic containers and more particularly relates to ring type openers for mounting on such containers.

2. Brief Description of the Prior Art

Representative of the prior art is the disclosure of U.S. Pat. No. 3,804,282.

SUMMARY OF THE INVENTION

The invention comprises a ring-type opener for a plastic container having an integrally molded, hermetically sealed, bulbous cap portion, which comprises;

a cylindrical ring member open at first and second ends and having a bore therethrough communicating between the open ends;

threads on the wall of said bore adjacent said first end, adapted to mate with threads on said plastic container immediately beneath said cap portion;

retainer means attached to said cylindrical member and partially closing said second end; and chisel means mounted on the walls of said bore above said threads and extending toward said second open end at an angle so as to engage with the underside of said bulbous cap portion of the container when said cylindrical member is mounted thereon, said engagement being uniform on all sides of said cap.

DETAILED DESCRIPTION OF THE PREFERRED EMBODIMENTS OF THE INVENTION

Plastic containers, i.e.; containers made of polymeric resin materials such as polyethylene, polypropylene, acrylonitriles, polycarbonates and the like are well-known in the art. The manufacture of such containers so that they have an integrally molded, hermetically sealed cap portion is also well-known; see for example U.S. Pat. Nos. 3,325,860 and 3,919,374. The present invention pertains to such containers wherein the cap portion has a bulbous configuration, i.e.; an undercut at the cap base.

Figure 1:
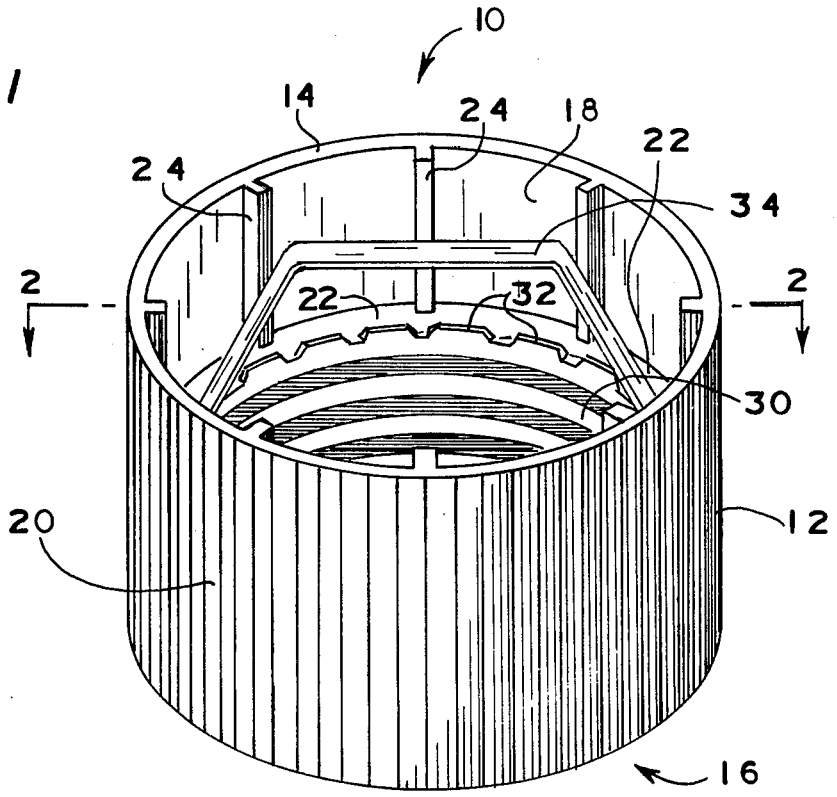
FIG. 1 is an isometric view from slightly above a preferred embodiment ring opener of the invention.
Figure 2:
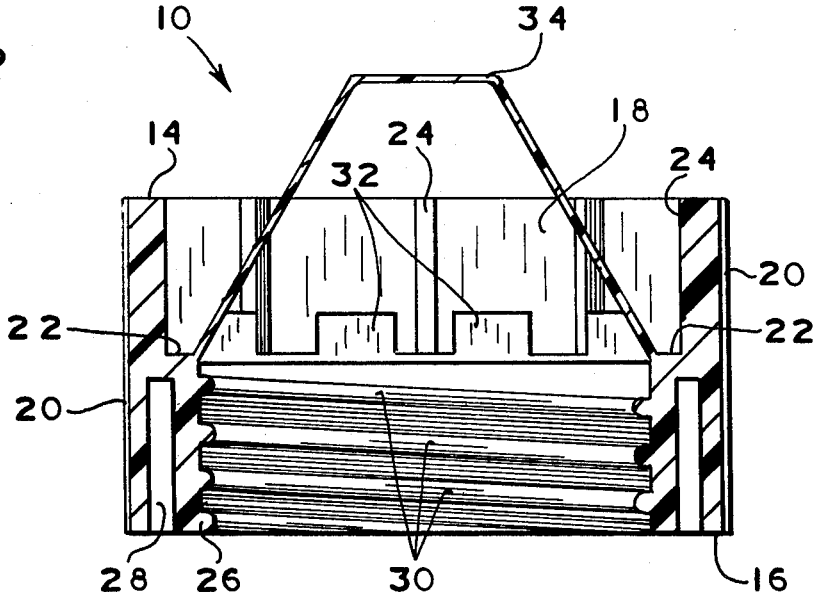
FIG. 2 is a cross-sectional side elevation along lines 2—2 of FIG. 1.

FIG. 1 is an isometric view, as seen from slightly above a preferred embodiment ring opener 10 of the invention. The ring opener 10 may be manufactured from any convenient material, preferably a polymeric resin having structural strength such as a high density polyethylene, polypropylene or polycarbonate. The ring opener 10 comprises a cylindrical ring member 12 having an open first end 16 and an open second end 14. A bore communicates between the open ends 14, 16 and is defined by the inner walls 18 of the ring member 12. The outer surface of ring member 12 is preferably striated to present ridges 20. The ridges 20 on the outer surface of ring member 12 present a frictional surface to facilitate grasping the ring member 12 for rotation with the operators fingers. In the preferred ring opener 10, a flange circumscribes inner walls 18 midway between ends 14, 16. Rising vertically from flange 22 are ribs members 24 which strengthen the ring member 12 from compression forces which may be exerted on the ring member 12. As seen best in FIG. 2, a cross-sectional side elevation of the ring opener 10, the inner wall 18 beneath flange 22 bears an annular recess 28 which together with the inner wall of ring member 12 defines a false wall 26, bearing threads 30 on its inner surface. The annular recess 28 functions to isolate stresses placed upon the outer surface 20 of ring member 12 from affecting the engagement of threads 30 with mating threads on the plastic container to be opened with ring opener 10. For example, the container to be opened may be of a very thin, flexible polymeric resin material which would collapse if squeezed between the fingers of the operator. The flexibility of the lower portion of ring opener 10 due to the annular recess 28 separating the outer striations 20 from the threads 30 prevents such a collapse. In the preferred embodiment 10 of the invention, a plurality of chisel surfaces 32, mounted on flange 22, extend inwardly at an angle towards the open end 14. The angulation of the chisel surfaces 32 may best be seen with reference to FIGS. 3–5, inclusive. The function of chisels 32 will be described in greater detail hereinafter. Also, mounted on flange 22 and extending upwardly to partially close the second end 14 is strap 34, a flexible, slightly elastic means for retaining the severed cap portion of a plastic container as will also be described in greater detail hereinafter.

Figure 3:
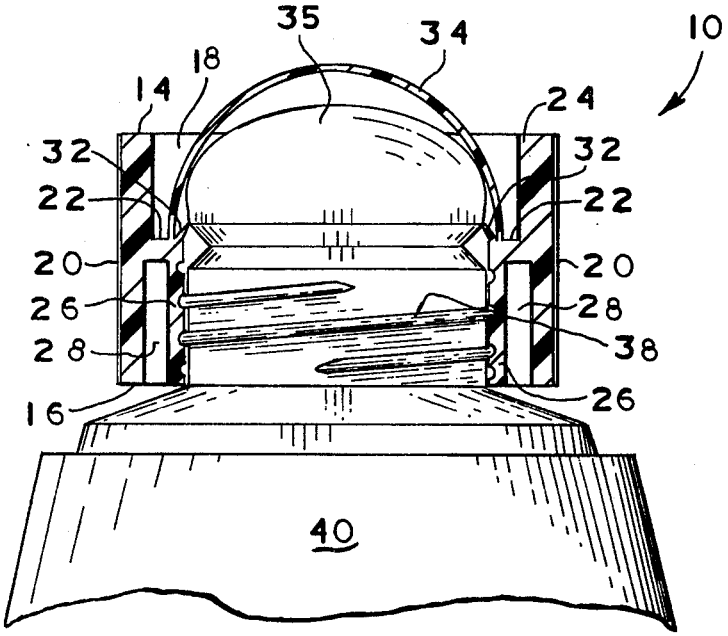
FIG. 3 is a view as seen in FIG. 2 but with the ring member of the invention mounted on a plastic container having an integrally molded, hermetically sealed, bulbous cap portion.

Referring now to FIG. 3, one may see the ring opener 10 mounted on a plastic container 40 having an integrally molded, hermetically sealed, bulbous cap 35. The ring opener 10 is secured via its threads 30 to mating threads 38 on container 40. The mating threads 38 are positioned immediately below and adjacent to cap 35. It will be seen in FIG. 3 that ring opener 10 is initially positioned on container 40 so that chisels 32 are at the base or undercut position of the bulbous cap 35. This is so that when the ring opener 10 is rotated to raise off threads 38, chisels 32 will be in an immediate position for lifting the cap 35 and fracturing its connection with the rest of package 40 along the base line or undercut. The ring opener 10 is assembled with container 40 merely by screwing it downward on threads 38 until it makes the position shown in FIG. 3. Generally, the materials of container 40 and ring opener 10 are flexible enough to permit passage of the ring opener 10 to this position, although the cap 35 may have a slightly larger diameter than found across chisels 32. When assembled as shown in FIG. 3, the user of the package 40 can immediately note that the package has not been opened because there is a slight space between retaining strap 34 and cap 35. In general, a few millimeters of space between strap 34 and cap 35 are an established relationship between the initially mounted ring opener 10 and container 40.

To sever the integrally molded, hermetically sealed cap 35 from the body of container 40, one merely rotates ring opener 10 to raise it off the package 40 on threads 38. This may be seen by referring now to FIG. 4, a view as seen in FIG. 3 but with the cap 35 severed and raised.

Figure 5:
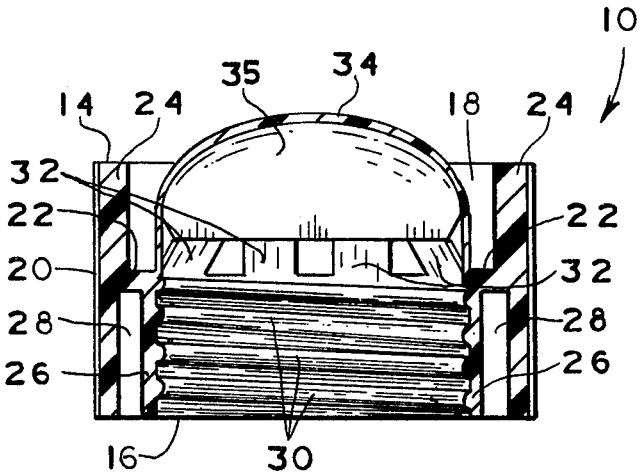
FIG. 5 is a cross-sectional side elevation of the embodiment ring opener of the invention following severance of the cap portion of a plastic container as shown in FIG. 4, and after removal of the ring opener from association with the plastic container.
Figure 4:
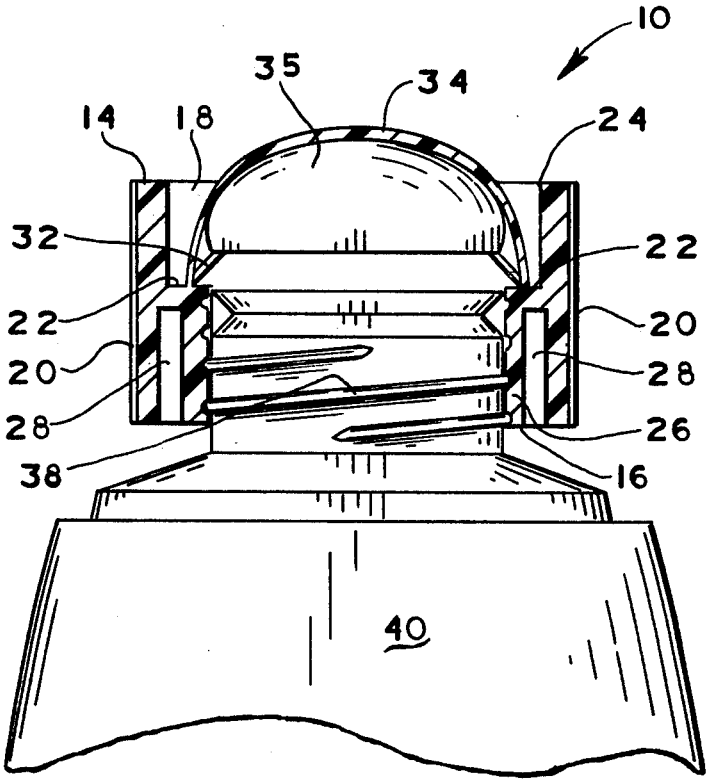
FIG. 4 is a view as seen in FIG. 3 but following severance of the cap portion of the container from the body of the container.

As shown in FIG. 4, ring opener 10 has been rotated on threads 38 to raise the ring opener 10. As ring opener 10 rises, chisels 32 are forced against the base of cap 35, exerting even pressure around the entire periphery of cap 35. The force of chisels 32 around the periphery of cap 35 fractures the cap and severs it from its connection with container 40. Ordinarily, fracture of cap 35 would propel it like a projectile away from package 40. However, retaining strap 34 prevents the propulsion of cap 35 in this manner. The retaining strap 34 also functions to hold cap 35 in a level position, i.e.; on a plane parallel to the axis normal to the axis of package 40. This ensures that an even fracture is obtained around the base of cap 35. This ensures that complete severance of the cap 35 will be obtained, i.e.; a partial connection is unlikely to be maintained between cap 35 and container 40. It will be noted also in FIG. 4 that the chisels 32 continue to hold cap 35 against retaining strap 34. Referring now to FIG. 5, a cross-sectional side elevation in part of the ring opener 10 may be seen in closing and holding cap 35 between chisels 32 and retrining strap 34. Since the cap 35 and ring opener 10 are maintained as a unit after removal from package 40, they may be used again to at least partially close the opening made in package 40 by rethreading the unit with enclosed cap back on to threads 38. The technician will always be apprised however that opening in package 40 has been made simply by observing that the cap 35 is held in tension against the strap 34. Thus, the technician is warned that entry of package 40 with consequent loss of sterility may have occurred.

From the above description, it will be obvious to those skilled in the art that the ring opener embodiment 10 facilitates severance and removal of a hermetically sealed, integrally molded cap as generally found on the so-called prefilled, integrally molded and filled plastic container. The ring opener of the invention has particular advantage in that opening occurs normally, i.e.; upon unscrewing to remove the ring opener 10 from package 40. In some of the prior art devices for opening similar packages, one must initially tighten or screw down the opening device, which is not normal to the operator's natural instinct to unscrew the device. Thus, the prior art devices are often confusing and wasteful of the operator's time.

What is claimed is:

1. A ring-type opener for a plastic container having an integrally molded, hermetically sealed, bulbous cap portion, which comprises;

a cylindrical ring member open at first and second ends and having a bore therethrough communicating between the open ends;

threads on the wall of said bore adjacent said first end, adapted to mate with threads on said plastic container immediately beneath said cap portion;

retainer means attached to said cylindrical member and partially closing said second end; and chisel means mounted on the walls of said bore above said threads and extending towards said second open end at an angle so as to engage with the underside of said bulbous cap portion of the container when said cylindrical member is mounted thereon, said engagement being uniform on all sides of said cap.

2. An opener according to claim 1 wherein said retainer means comprises a strap.

3. The opener of claim 1 wherein said chisel means comprises an interrupted annular projection.

* * * * *